US007318778B2

(12) United States Patent
Owens

(10) Patent No.: US 7,318,778 B2
(45) Date of Patent: Jan. 15, 2008

(54) GOLF PUTTER WITH REMOVABLE LASER

(76) Inventor: Mark R. Owens, P.O. Box 637, 865 Calcite Dr., Divide, CO (US) 80814

( * ) Notice: Subject to any disclaimer, the term of this patent is extended or adjusted under 35 U.S.C. 154(b) by 18 days.

(21) Appl. No.: 11/415,654

(22) Filed: May 2, 2006

(65) Prior Publication Data

US 2006/0281577 A1 Dec. 14, 2006

Related U.S. Application Data

(60) Provisional application No. 60/690,039, filed on Jun. 11, 2005.

(51) Int. Cl.
*A63B 69/36* (2006.01)

(52) U.S. Cl. ..... 473/220; 473/219; 473/223

(58) Field of Classification Search ..... 473/219, 473/220, 221, 222, 223, 224, 226, 257
See application file for complete search history.

(56) References Cited

U.S. PATENT DOCUMENTS 5,213,331 A * 5/1993 Avanzini ..... 473/220
5,374,063 A * 12/1994 Ogden ..... 473/220
5,388,832 A * 2/1995 Hsu ..... 473/220
5,733,202 A * 3/1998 Vargo ..... 473/220
6,123,626 A 9/2000 Osborn
6,227,983 B1 5/2001 Yang
6,383,087 B1 5/2002 Moser
6,840,869 B2 1/2005 Chen
6,875,122 B2 4/2005 Collins et al.
6,902,493 B1 6/2005 Rhodes et al.

* cited by examiner

*Primary Examiner*—Nini F. Legesse
(74) *Attorney, Agent, or Firm*—Raymond M. Galasso; Galasso & Associates, LP

(57) ABSTRACT

A golf putter wherein the putter is equipped with a removable laser. The head of the putter includes a mounting plate which has a mounting plate cover. When the laser is not in use, the mounting plate cover is placed on the mounting plate. When the laser is in use, the laser which includes a mounting bracket is attached to the mounting plate. The shaft of the putter includes a battery located inside of the shaft and the electrical connection to the at least one battery. The electrical connection to the laser is located in the center of the mounting plate and is covered by a cap when not in use. An on/off switch and a height adjustment switch are located on the shaft. The on/off switch controls the electricity to the laser and the height adjustment switch allows a user to pivot the laser as necessary.

13 Claims, 4 Drawing Sheets

GOLF PUTTER WITH REMOVABLE LASER

RELATED APPLICATIONS

This application claims priority to co-pending provisional patent application Ser. No. 60/690,039 filed on Jun. 11, 2005 entitled Owen's Laser Pro Putter.

FIELD OF THE DISCLOSURE

A golf putter which is equipped with a removable laser for lining up the ball with the hole.

BACKGROUND

Everyone who has ever played golf knows how hard it is to get the ball aimed in the right direction and actually hit the ball in the same direction. Everyone has a unique stroke or technique for lining the ball up with the hole, swinging and actually striking the ball. There is no right way or wrong way to line up and hit a golf ball.

Most every golf course offers lessons on golf, from the basics to more advanced techniques. Of course, the best way to improve your golf game is to practice, practice, practice. Not only does playing a game of golf help improve your game but hitting buckets of balls and just spending time practicing putting.

There are a lot of help devices available as well. For example, there are devices that you can purchase that plug into electricity so that you can practice putting indoors. These devices come in different sizes and shapes but there basic function is to allow a user to practice putting. There are also a number of golf clubs that are equipped with laser type devices.

One example of a laser device used in connection with a golf club is described in U.S. Pat. No. 6,123,626 by Osborn. In this configuration, illustrates the use of a laser which is connected to the shaft of the putter over the upper surface of the club head. The laser disclosed is also equipped with a range finder which is visibly displayed for the user.

In U.S. Pat. No. 6,227,983 by Yang, a laser is disclosed wherein the laser is located within a recessed chamber of the club head. Additionally, the club includes an elongated slot on a face thereof in communication with the recessed chamber.

Another laser device is disclosed in U.S. Pat. No. 6,383,087 by Moser. In this patent, the use of a mirror attached to the toe of the putter head. The location of the laser is such that when the putter is in position to strike the ball, the projected beam of light is reflected in the mirror on the putter head back to the housing from which the laser beam is projected.

U.S. Pat. No. 6,840,869 by Chen discloses an aiming device for a golf club wherein the aiming device includes a fixing seat which attaches to the shaft of a club or the grip. The laser is pivotable on the main body.

Collin et al. discloses the use of a laser in connection with a putter in U.S. Pat. No. 6,875,122. The use of a laser attached putter face is described wherein the laser is powered by a battery located on the grip of the putter. The electrical connection is wound around the shaft of the putter and connected to the battery source. This particular configuration allows for the laser to be removed when not in use.

Finally, in U.S. Pat. No. 6,902,493 by Rhodes et al. a laser device is disclosed which includes a laser, an on/off switch a reflective surface rotatable by a handle and a lever system, a PC board, and a switch to prevent the laser from being accidently shone in the eyes of other persons.

These are just a few examples of various kinds of configurations comprising lasers. One thing is for sure, everyone who wants to improve their golf game certainly has the ability to do so if they are willing to allocate the time and money to do so.

SUMMARY OF THE DISCLOSURE

In one embodiment the putter comprises a head.

In still another embodiment the putter comprises a shaft attached to the head.

In yet another embodiment the putter includes a mounting plate.

In still another embodiment the mounting plate is located on the top of the putting head.

In another embodiment the putter comprises a removable mounting plate cover.

In yet another embodiment the mounting plate cover is capable of attaching to the mounting plate.

In still another embodiment the putter includes a laser having a mounting bracket.

In another embodiment the mounting bracket is capable of attaching to the mounting plate.

In yet another embodiment the putter includes at least one battery.

In still another embodiment the at least one battery is located with the shaft of the putter.

In another embodiment the putter comprises an on/off switch.

In yet another embodiment the on/off switch is located on the shaft.

In still another embodiment the on/off switch is attached to the at least one battery.

In another embodiment the putter comprises a height adjustment switch.

In yet another embodiment the height adjustment switch is located below the on/off switch.

In still another embodiment the height adjustment switch is capable of pivoting the laser upward and downward.

In another embodiment the putter includes an electrical connection.

In yet another embodiment the electrical wires are located inside the shaft and are connected to the at least said one battery.

In still another embodiment the putter contains an electrical connection located in the center of the mounting plate for connecting electricity to the laser.

In another embodiment the laser having a mounting bracket weighs the same as the mounting plate cover.

In yet another embodiment the at least one battery is located in the grip of the shaft.

In another embodiment the mounting plate comprises a retainer for attaching the mounting plate cover.

In yet another embodiment the electrical connection to the laser is a plug in connection.

In still another embodiment the at least one battery is a AA battery.

Still other advantages of various embodiments will become apparent to those skilled in this art from the following description wherein there is shown and described preferred embodiments of this invention simply for the purposes of illustration. As will be realized, the invention is capable of other different aspects and embodiments without departing from the scope of the invention. Accordingly, the advantages, drawings, and descriptions are illustrative in nature and not restrictive in nature.

DETAILED DESCRIPTION OF THE DRAWING FIGURES

In the following detailed description of the preferred embodiments, reference is made to the accompanying drawings which form a part hereof, and in which is shown by way of illustration specific preferred embodiments in which the invention may be practiced. These embodiments are described in sufficient detail to enable those skilled in the art to practice the invention, and it is to be understood that other embodiments may be utilized and that logical, mechanical and electrical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Figure 1:
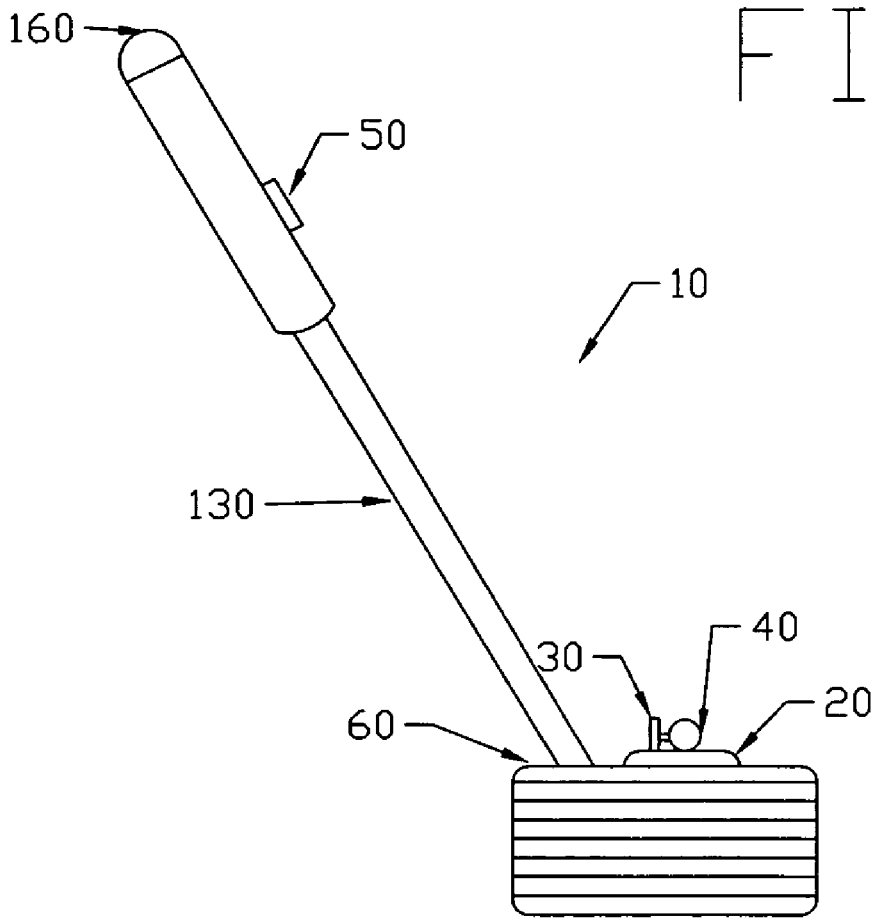
FIG. 1 is a side view of a golf putter having a laser mounted on the top of the head.

FIG. 1 illustrates the face of a golf putter 10 having a mounting plate 20, a mounting bracket 30, a laser 40, an on/off switch 50. The golf putter 10 comprises a mounting plate 20 which is located on the head 60. The mounting plate 20 is capable of receiving the mounting bracket 30 of the laser 40 by inserting the mounting bracket 30 of the laser 40 into the retainer located on the mounting plate 20. The retainer can be a ball and socket type connection or any other type of retainer. Once the mounting bracket 30 of the laser 40 is connected to the mounting plate 20, the electrical connection 80 is connected to the laser 40 by inserting the electrical connection 80 into the opening 90. The opening 90 which is located in the center of the mounting plate 20 is equipped with a cap 100 which is removable. Once the cap 100 is removed, the electrical connection from the laser 40 can be inserted into the cap 100 creating an electrical connection to the battery 110. Once an electrical connection has been established the laser 40 can be pivoted by using the height adjustment switch 120 which is located on the shaft of the putter 10.

Figure 2:
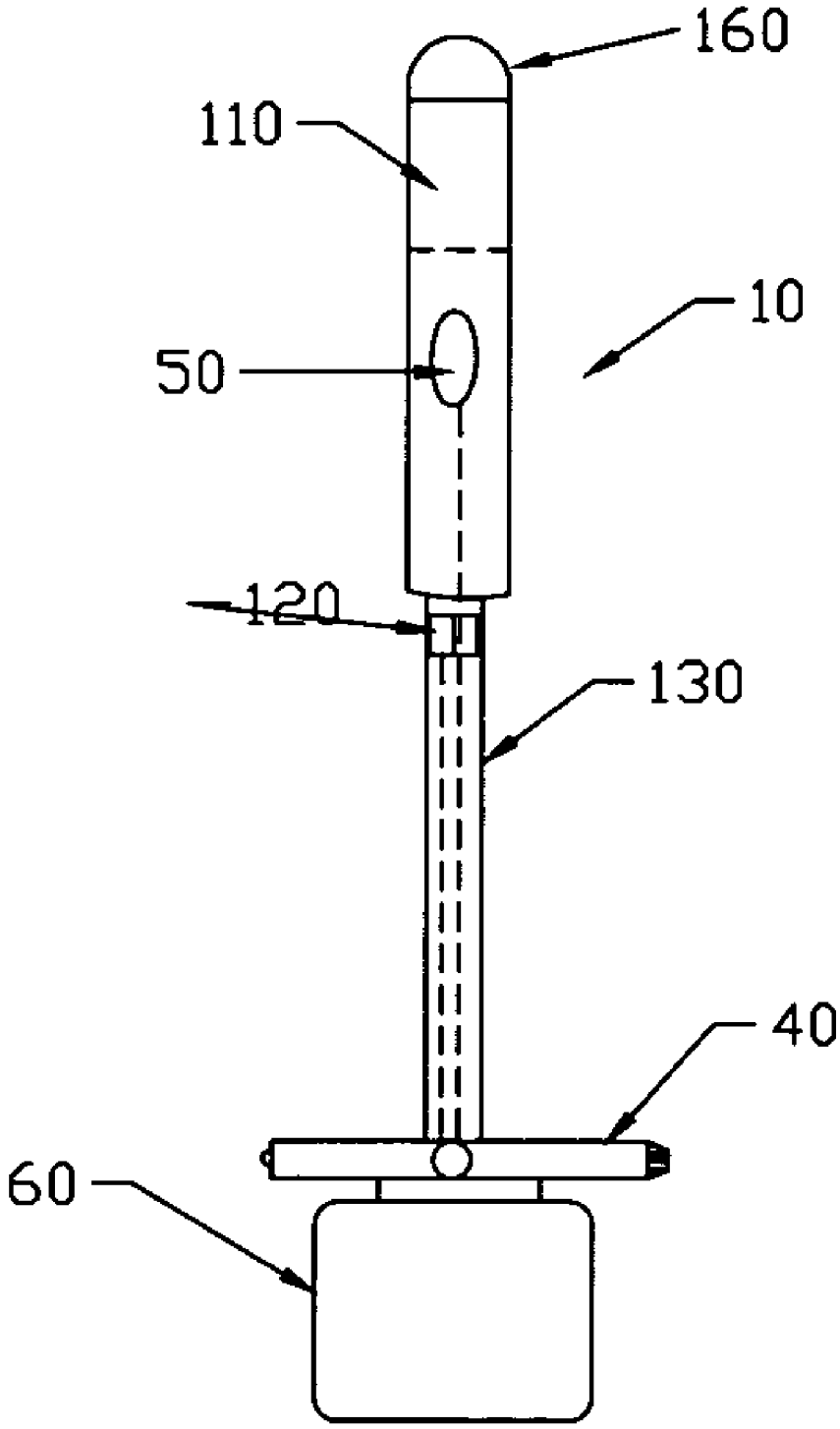
FIG. 2 is a front view of the golf putter depicted in FIG. 1.

FIG. 2 depicts the front of the view of the golf putter 10 wherein the mounting plate 30 of the laser 40 is seen in a mounted position attached to the mounting plate 20. The on/off switch 50 is shown on the shaft 130 of the putter 10. The on/off switch 50 functions to turn power on and off to the electrical connection 80 which is located in the mounting plate 10. The laser 40 is connected to the electrical connection 80 and receives power when the on/off switch is in the on position. When preparing to remove the laser 40 from the putter 10, the on/off switch should be in the off position. Additionally, when replacing the battery 110 in the shaft 130, the on/off switch should be in the off position. In the present embodiment, a single AA battery is disclosed. However, other types of batteries can be used and the number of batteries can vary. The battery 110 is inserted into the shaft 130 by removing the shaft cap 160. Once the battery is inserted, the shaft cap 160 is replaced. FIG. 2 also illustrates the height adjustment switch 120. The height adjustment switch 120 functions to pivot the laser 40 once the mounting bracket 30 of the laser 40 are mounted to the mounting plate 20. By pivoting the laser 40, the laser 40 can more easily be lined up with the hole.

Figure 3:
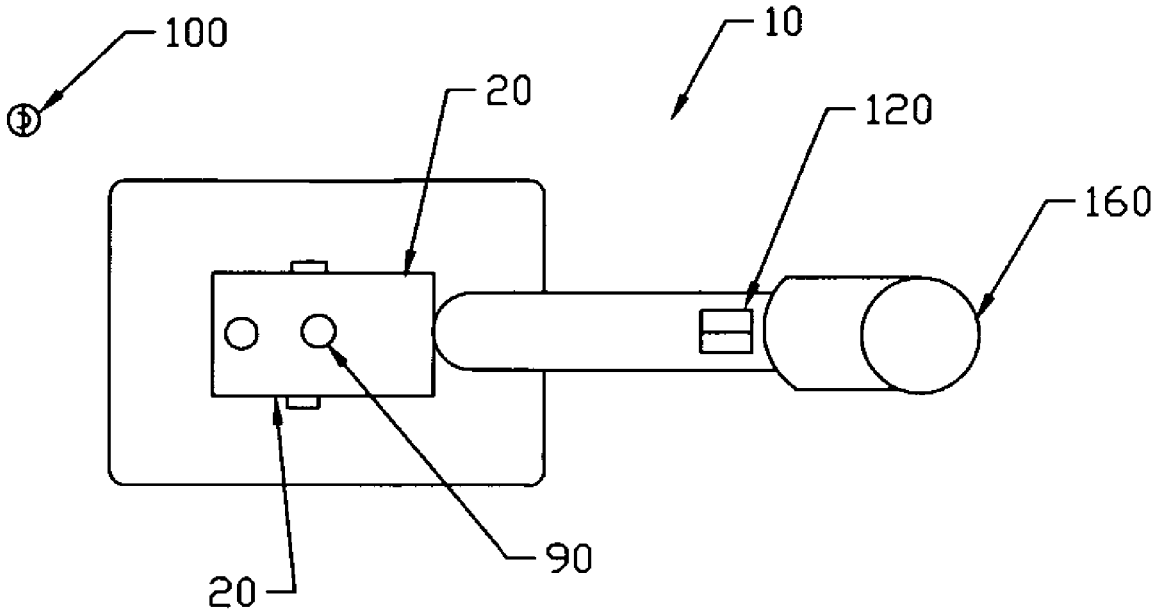
FIG. 3 is a top view of a golf putter showing the mounting plate.

FIG. 3 illustrates a top view of the mounting plate 20 wherein the mounting bracket 30 of the laser 40 are removed. When the laser 40 is not in use, it can be removed from the mounting plate 20 by disconnecting the mounting bracket 30 wherein the mounting bracket 30 of the laser 40 are separate and the laser 40 having the mounting bracket 30 can be placed into a pouch for storage. When the laser 40 having the mounting bracket 30 is not in the mounted position, the mounting plate 20 has a cap 100 which fastens over the opening in the mounting plate 20.

Figure 4:
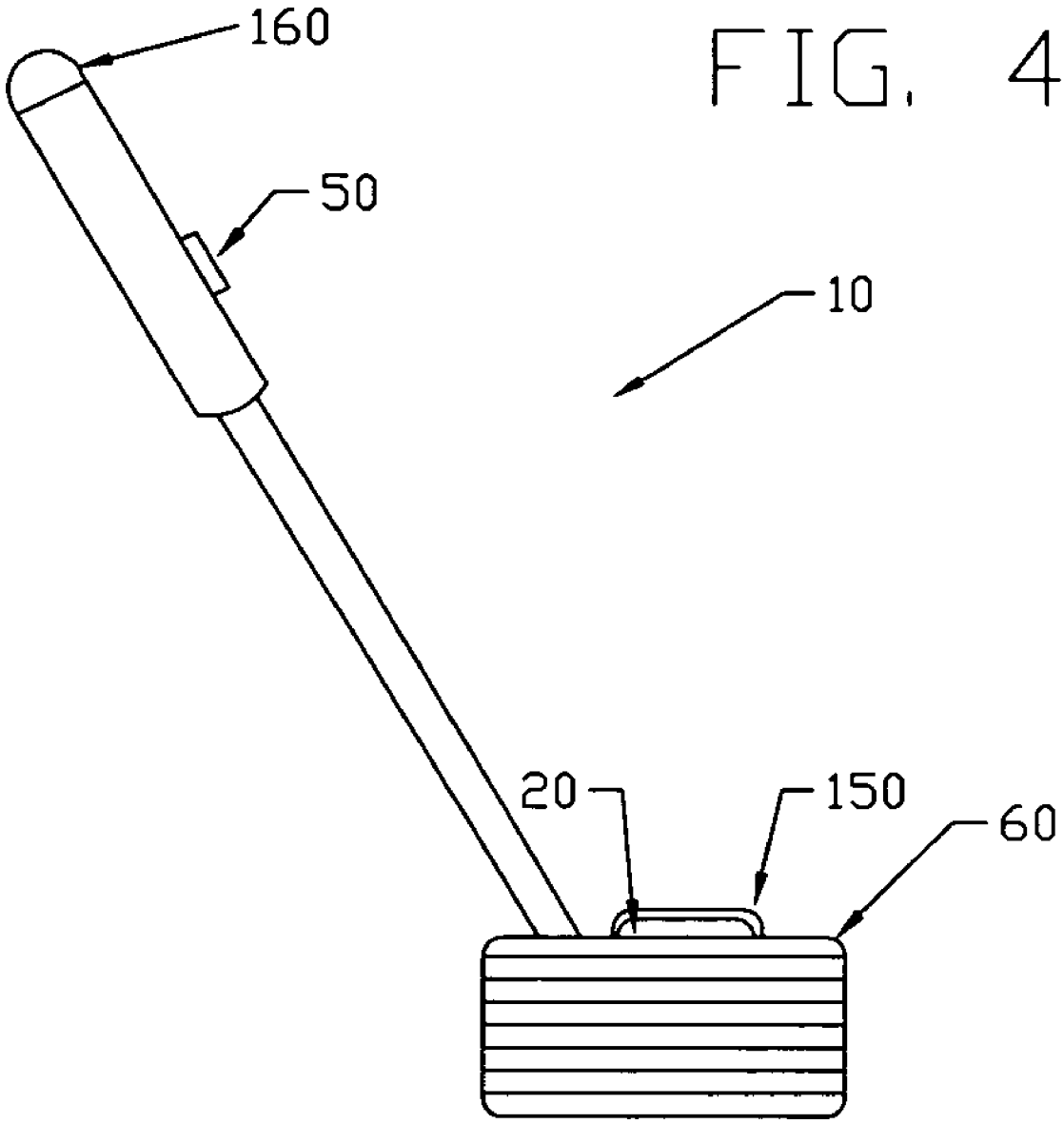
FIG. 4 is a side view of a golf putter illustrating a mounting plate and mounting plate cover.

FIG. 4 illustrates a side view of a golf putter 10 comprising a mounting plate 20. The mounting plate 20 is covered with a mounting plate cover 150. The mounting plate cover 150 protects the mounting plate 20 from dirt and water. The mounting plate cover 150 acts an additional protective means for protecting the electrical connection 80 which is located in the center of the mounting plate 20. Additionally, the mounting plate cover 150 weighs the same as the combination of the laser 40 having a mounting bracket 30. By having the mounting plate cover 150 weigh the same as the combination of the laser 40 having a mounting bracket 30, the user does not have to adjust their swing depending on whether the laser 40 is in a mounted position or not.

What is claimed is:

1. A putter comprising:

a putting head;

a shaft attached to said putting head;

a mounting plate located on the top of said putting head;

a removable mounting plate cover capable of attaching to said mounting plate;

a laser having a mounting bracket capable of being attached to the mounting plate;

at least one battery located in the shaft of the putter;

an on/off switch located on said shaft; wherein said on/off switch is attached to said battery;

a height adjustment switch located below said on/off switch on said shaft; wherein said height adjustment switch is capable of pivoting said laser upward and downward;

an electrical connection where in the electrical wires are located inside the shaft and are connected to said battery; and an electrical connection capable of connecting to said laser.

2. The putter of claim 1 wherein said laser having a mounting bracket that weighs the same as the mounting plate.

3. The putter of claim 1 wherein said batteries are located in the grip of said shaft.

4. The putter of claim 1 wherein said mounting plate comprises a retainer for attaching said mounting bracket.

5. The putter of claim 1 wherein said electrical connection to said laser is a plug in connection.

6. The putter of claim 1 wherein said battery is a AA battery.

7. The Putter of claim 1 wherein the mounting plate comprises an opening for said electrical connection to be located in the center of said mounting plate.

8. The putter of claim 7 wherein said electrical connection is comprised of a retainer.

9. A puffer laser system comprising:

a putting head;

a shaft attached to said putting head;

a mounting plate located on the top of said putting head;

a removable mounting plate cover capable of attaching to said mounting plate;

a laser having a mounting bracket capable of being attached to the mounting plate;

at least one battery located in the shaft of the puffer;

an on/off switch located on said shaft; wherein said on/off switch is attached to said battery;

a height adjustment switch located below said on/off switch on said shaft; wherein said height adjustment switch is capable of pivoting said laser upward and downward;

an electrical connection wherein the electrical wires are located inside the shaft and are connected to said battery; and an opening located in the center of the mounting plate, wherein said opening includes a retainer for attaching and detaching said laser to said electrical connection.

10. The putter laser system of claim 9 wherein said laser having a mounting bracket that weighs the same as the mounting plate cover.

11. The putter laser system of claim 9 wherein said batteries are located in the grip of said shaft.

12. The putter laser system of claim 9 wherein said battery is a AA.

13. A method of using a putter having a laser comprising a mounting bracket, a mounting plate, a mounting plate cover and electrical connection, comprising the steps of:

removing said mounting plate cover;

attaching said laser to said mounting plate by said mounting bracket;

connecting the electrical connection to said laser;

turning on the on/off switch;

adjusting the height of the laser using a height adjustment switch;

putting;

disconnecting said electrical connection from said laser;

removing said laser by removing the mounting bracket from said mounting plate; and replacing said mounting plate cover.

* * * * *